US007011119B2

(12) United States Patent
Fink, Jr.

(10) Patent No.: US 7,011,119 B2
(45) Date of Patent: Mar. 14, 2006

(54) VAPOR TRAPPING AND CONTROLLING CONTAINER

(75) Inventor: Arthur C. Fink, Jr., Lonedell, MO (US)

(73) Assignee: Husky Corporation, Pacific, MO (US)

( * ) Notice: Subject to any disclaimer, the term of this patent is extended or adjusted under 35 U.S.C. 154(b) by 0 days.

(21) Appl. No.: 11/043,526

(22) Filed: Jan. 26, 2005

(65) Prior Publication Data

US 2005/0161111 A1 Jul. 28, 2005

Related U.S. Application Data

(60) Provisional application No. 60/539,848, filed on Jan. 28, 2004.

(51) Int. Cl.
*B65B 3/16* (2006.01)

(52) U.S. Cl. ..... 141/114; 141/44; 141/52; 141/286; 141/313

(58) Field of Classification Search ..... 141/10, 141/39, 40, 44, 52, 286, 313, 314; 55/364
See application file for complete search history.

(56) References Cited

U.S. PATENT DOCUMENTS

| | | | | |
|---|---|---|---|---|
| 3,763,901 | A | 10/1973 | Viland | |
| 3,807,396 | A | 4/1974 | Fischel | |
| 3,978,694 | A | 9/1976 | Hughes et al. | |
| 4,108,160 | A | 8/1978 | Harper | |
| 4,131,141 | A * | 12/1978 | Weissenbach | 141/285 |
| 5,058,631 | A | 10/1991 | Grant | |
| 5,176,187 | A | 1/1993 | Grant | |
| 5,343,908 | A | 9/1994 | Furstenberg | |
| 5,655,579 | A | 8/1997 | Prescott et al. | |
| 6,070,365 | A | 6/2000 | Leonard | |
| 6,553,713 | B1 | 4/2003 | Chiu | |
| 6,805,173 | B1 * | 10/2004 | Healy | 141/59 |

* cited by examiner

*Primary Examiner*—Timothy L. Maust
(74) *Attorney, Agent, or Firm*—Paul M. Denk

(57) ABSTRACT

An underground tank releases vapors depending upon air pressure. As pressure increases, vapors decline. When pressure decreases, vapors increase and escape the tank or spill to pollute the atmosphere. A container for trapping vapors has a housing upon a base. Within the housing one or more bags hang upon stems connected to piping at fittings. The stems have perforations to admit vapors into the bags. The stems are connected serially to the piping upon the base. As vapors enter the piping, the bags inflate within the housing. When tank or spill pressure declines, the vapors exit the bags and return to the tank or spill via the piping.

7 Claims, 1 Drawing Sheet

VAPOR TRAPPING AND CONTROLLING CONTAINER

CROSS REFERENCE TO RELATED APPLICATION

This non-provisional patent application claims priority to the provisional patent application having Ser. No. 60/539,848, which was filed on Jan. 28, 2004.

BACKGROUND OF THE INVENTION

The vapor trapping container relates to underground fuel storage tank vapor pressure control, in general, and more specifically, to the containment of vapors as released from a tank during dispenser shutdown. A unique aspect of the present invention is a perforated stem supporting a bag.

As is well known, the motorist refuels his/her vehicle at a service station. The fuel is pumped from an underground tank, by the dispenser, through a hose and nozzle, for filling the vehicle fuel tank. Normally, the vapors generated within the fuel tank, through fueling, are returned through the vapor path of the fuel hose, back to the dispenser, either by the balanced pressure method, or by a pump, and then are returned to the underground storage tank for containment. As the tank truck replenishes the fuel in the underground storage tank, when the vapor pressure within the tank becomes positive, or even excessive, the vapors must be controlled. Normally, during the day, or evening, when fuel is continuously pumped from the underground storage tank, by the dispenser, to replenish vehicles, generally a more negative form of vapor pressure will be located within the underground storage tank. But, in the evening, when vapors begin to generate, less fuel is pumped from the underground tank, the pressure may build up a little more excessively. Hence, unless this vapor pressure is controlled, released to atmosphere, which regulations will not allow, or is burned, which is also not authorized by law, these vapor pressures either will leak, or can become dangerous. But, through usage of the current invention, means, such as a diaphragm type bag, or expandable bag, or simply a bag that can be inflated, can be attached to a vent of the underground storage tank, accumulate the expanding fuel vapor pressures, and hold them in a safe manner, until such time, during the next day, when fuel is continuously pumped from the underground storage tank, and such vapors can be returned therein. Then the vapor pressure storage bag is deflated, during another daily cycle, of the dispensing of fuels from such an underground storage tank. As is well known in the art, such storage tanks are located underground at most, or all, service stations.

Escaped gasoline vapors raise pollution concerns and trigger governmental regulations. Normally, balance type II vapor recovery stations operate at a negative pressure except during closure of the station. A closed station allows the natural formation of vapors from the evaporation of fuel. Small vapor growth occurs during closure of a station. However, vapors may escape to the atmosphere, causing pollution or increase pressure, adversely affecting station operations.

Prior art designs provide vapor collection with refrigeration, membranes, bags, and containers on vents. Though collecting vapors, the prior art required additional mechanical equipment and controls while not returning vapors to their source. The prior art also tends to have higher installation and operational costs.

The present art overcomes the limitations of the prior art. That is, in the art of the present invention, a vapor trapping container retains vapors in an expandable bag and returns the vapors to a confined space at lower pressure without mechanical equipment. In other words, no other vapor paths are required.

The difficulty in providing a vapor trapping container is shown by the operation of a typical vapor recovery system. Hydrocarbon vapors collect in an underground tank or spill. A controlled vacuum device alters the pressure to withdraw the vapors from the tank. The vapors then undergo desiccation and refrigeration in separate machinery from the tank or spill to return and become liquid again. The liquid is then returned to near the bottom of the tank or removed from a spill site. In operation, the typical system requires electrical power and skilled labor to install, to operate, and to maintain the vacuum device, and desiccation and refrigeration processes. The present invention overcomes these difficulties.

The use of containers to capture escaping vapors is known in the prior art. For example, U.S. Pat. No. 2,758,747 to Stevens discloses a multiple compartment tank that conveys different commodities.

The patent to Viland, U.S. Pat. No. 3,763,901, shows a method of preventing loss of hydrocarbons into the atmosphere. This method refrigerates and condenses vapors to liquid and returns the liquid to a tank. This patent covers more of a storage bag with some rigidity rather than an inflatable bag.

The patent to Fischel, U.S. Pat. No. 3,807,396, shows a life support system to recycle gaseous oxygen. The system has multiple vessels and an expansion bag as a water trap.

The patent to Hughes et al., U.S. Pat. No. 3,978,694, shows a vapor saving system for a dry cleaning machine. The system retains dry cleaning solvent vapors when an operator opens a door. An impervious bag in the system collects solvent vapors.

The patent to Harper, U.S. Pat. No. 4,108,160, shows a solar water heating apparatus with an expandable vapor recovery bag. The bag attaches to the vent but the vent does not extend through the length of the bag and lacks perforations.

The patent to Grant, U.S. Pat. No. 5,058,631, shows flexible gas salvage containers for use with refrigerants. Upon filling the bags with recovered refrigerant, an operator removes the bags to a collecting point. No perforated stem extends into the bags.

The next patent to Grant, U.S. Pat. No. 5,176,187, shows a related flexible gas salvage container used in the automotive air conditioning field. This patent defines a refrigerant vapor recovery system that has bags connected to a pump or manifold.

The patent to Furstenberg, U.S. Pat. No. 5,343,908, shows a liquid containment system designed to prevent vapor formation. This system has membranes under pressure and bolted to a base, but lacks a bag shaped component.

The patent to Prescott et al., U.S. Pat. No. 5,655,579, shows a method and apparatus to test a fire suppression system. A bag in this system collects discharged fire suppressant but does not reload the suppressant into the system.

The patent to Leonard, U.S. Pat. No. 6,070,365, shows a domed explosion vent. The vent releases pressure above a certain value from within a building. A panel of the vent deflects to release vapors generated during an explosion.

The patent to Chiu, U.S. Pat. No. 6,553,713, shows a method and device for re-forestation and flood control. The device has a tent housing of flexible material with a sand base to weigh down an individual unit. The housing has openings with check valves to maintain pressure within the housing at or near ambient air pressure. The housing may store water to irrigate plants.

Thus, prior art devices do not provide for a flexible vapor trapping container that retains vapors in response to pressure changes in a storage tank. The flexible vapor trapping container inflates with vapors released from a tank, stores the vapors, returns the vapors and/or condensate to the tank, and deflates until the cycle repeats.

SUMMARY OF THE INVENTION

A vapor trapping container includes piping from an underground tank. The piping enters a housing and then a flame arrestor. The piping continues to one or more fittings with a vertical or approximate stem and a final fitting terminates the piping also in a vertical stem. The stems have perforations, and a container such as a bag rests upon each stem. A stem extends affixedly for the full length of the bag. As pressure increases in a tank, or ambient air pressure lowers, vapors enter the stem, exit the perforations, and inflate one or more bags. Ambient air pressure regulates the amount of bag inflation. The housing covers the bags and has sufficient volume for all bags to inflate within. A platform serves as the base for the housing. When pressure decreases in a tank or ambient air pressure rises, the bags deflate and return vapors to the tank.

DESCRIPTION OF THE PREFERRED EMBODIMENT

The present art overcomes the prior art limitations by providing a perforated stem inside of a bag for the approximate length of the bag. At service stations, vapors escape the storage tank and piping during fueling of vehicles and loading of vehicle tanks. An increase in tank pressure may force vapors out of a storage tank. Normally, balance type II vapor recovery stations operate at a negative pressure unless the station closes. A closed station allows the natural formation of vapors from evaporation of fuel. The vapors may escape to the atmosphere causing pollution or increased pressure hindering station operations, and compliance with regulations.

Figure 1:
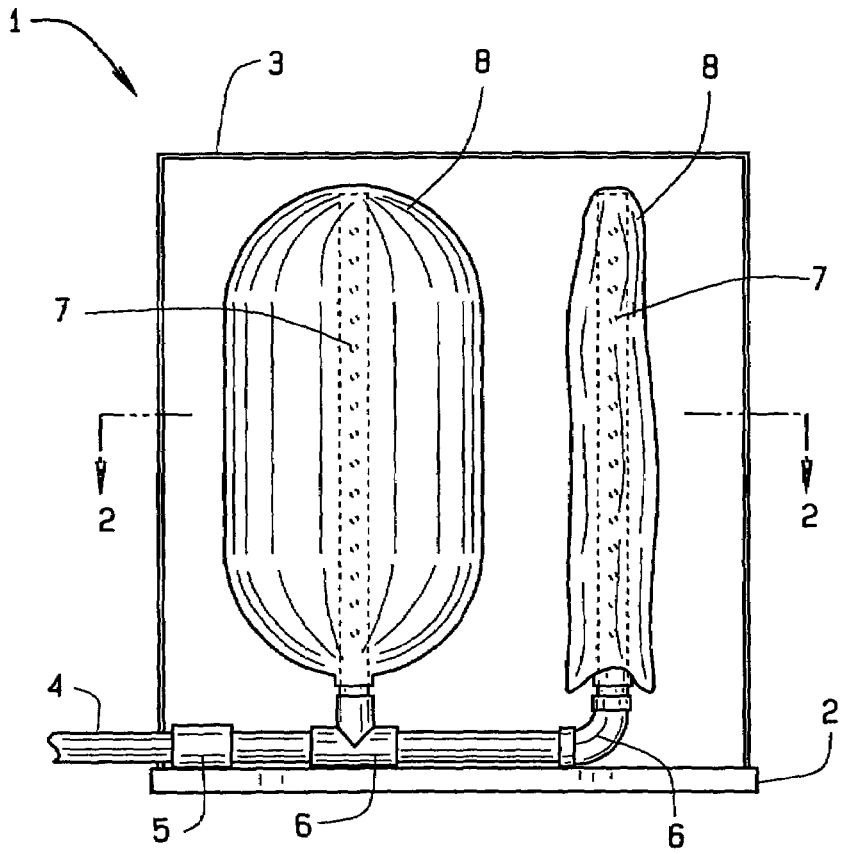
FIG. 1 shows an elevational view of the preferred embodiment of the vapor trapping container constructed in accordance with the principles of the present invention.

In referring to FIG. 1, the preferred embodiment of the flexible container 1 for trapping vapors is shown at the terminus of piping 4 from an underground storage tank, or other vapor source [not shown]. The piping 4 carries vapors from a tank to and through a safety means 5 such as a flame arrestor and a flow restrictor. The vapors continue through the piping 4 to one or more fittings 6. As shown FIG. 1, the first fitting 6 is a tee with the vertical member of the tee oriented perpendicular to the horizontal. A stem 7 extends vertically from the tee. In the preferred embodiment, the stem 7 is a hollow round tube with regularly spaced perforations. A flexible container 1 fits over the stem 7 and secures to the stem 7 proximate at the tee. In the preferred embodiment, the flexible container 1 is a bag 8, plastic or textile, impermeable to hydrocarbons and of sufficient volume to retain a certain number of hours of vapor accumulation. The bag 8 withstands at least 1 psi of vapor pressure and prevents system pressure from exceeding 1 inch of pressure. At the tee, the flexible container 1 is shown inflated with vapors from the tank. This may occur at night as previously recognized.

A second fitting 6 is an elbow at the end of piping 4 provided within the invention. The elbow has a vertical orientation with another stem 7 extending vertically, arranged parallel to the platform stem 7 from the first fitting 6. This stem 7 is also a hollow tube with a regularly spaced array of perforations. This hollow tube is essentially a length of pipe, having a series of perforations therethrough, so that vapors can be added into the bag, or withdrawn therefrom, depending upon the vapor pressure conditions within the fuel storage tank. In addition, the pipe is generally vertically aligned, but it could take other angles, for example, depend downwardly, or even at a angle, since the bag will inflate with vapors, or collapse around the pipe regardless in what angular position the pipe, as a stem, is arranged. Another bag 8 fits over this stem 7. At the elbow, the bag 8 is shown deflated and awaiting vapors to collect. With the use of additional piping 4 and tees, multiple bags 8 may be employed to contain and hold vapors from various sized underground fuel storage tanks. A housing 3, generally rectangular, surrounds the bags 8 and has sufficient size to accommodate one or more inflated bags 8. The housing 3 secures to a rectangular platform or floor 2 and protects the bags 8 from ambient conditions.

Figure 2:
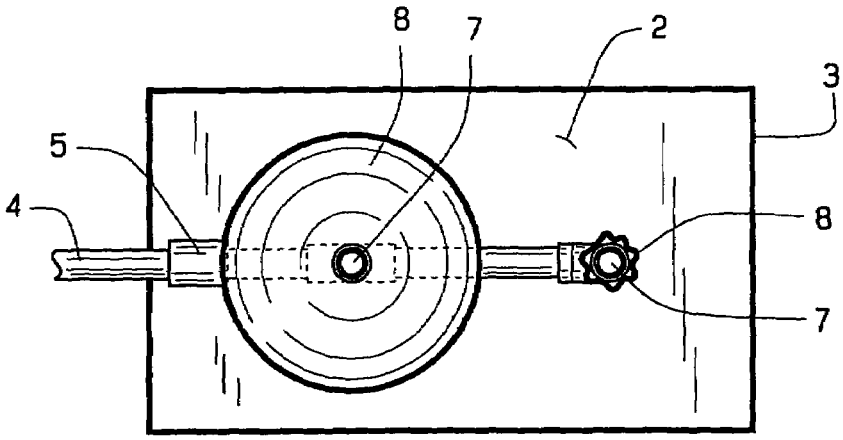
FIG. 2 shows a plan view of the vapor trapping container.

Viewing FIG. 2, the piping 4 enters the system upon the platform 2 and through the housing 3. After passing through a flame arrestor and controls, the flexible container 1 takes the form of an inflated bag 8. The bag 8 has a generally round cross section when inflated. A vertical stem 7 from the piping 4 supports the bag 8. Beyond the first bag 8, a second bag 8 hangs deflated upon a second vertical stem 7, awaiting its inflation. The housing 3 surrounds the bags 8 as in FIG. 1.

To utilize the present art, an operator connects piping 4 to the vent of an underground storage tank. When active use of the tank, pumping, filling, monitoring—ceases, vapors rise from fuel within the tank. Depending upon ambient pressure in the tank, the vapors enter the piping 4 and pass through the safety means 5, such as the valve. The vapors continue through the piping 4 and into one or more fittings 6. Each fitting 6 has a bag 8 hanging upon and affixed to a stem 7. As substantial pressure in the tank increases, more vapors depart the tank and enter the bags 8. The bags 8 inflate so long as vapors migrate from the tank. When pressure decreases in the tank, vapors return to the tank or condense and return by flowing into the tank through the piping 4. The piping 4 may have a slight slant to the tank to aid in the return of condensed vapors.

From the aforementioned description, a vapor trapping container has been described. The vapor trapping container is uniquely capable of containing hydrocarbon vapors at low pressure and returning the vapors to a tank. The vapor trapping container and its various components may be manufactured from many materials including but not limited to polymers, high density polyethylene HDPE, polypropylene PP, polyethylene terephalate ethylene PETE, polyvinyl chloride PVC, polystyrene PS, nylon, concrete e.g. for the floor, ferrous and non-ferrous metals, their alloys, and composites.

I claim:

1. A container for trapping vapors comprises:

a platform;

a housing, generally rectangular in plan and elevation and hollow, said housing covers the surface of said platform; piping admitted through said housing and generally centered upon said platform;

a means to enhance safety within said housing and in serial connection with said piping;

one or more fittings, allowing a horizontal connection in series with said piping and a vertical connection perpendicular to said horizontal connection; one or more stems, being hollow and extending from said fittings perpendicular to said platform, having a regular array of perforations and of a shaped cross section; one or more bags, having a generally round cross section and of flexible shape, and being impervious to hydrocarbon vapors, said bags rest upon the upper terminus of said stems and attach snugly to said stem proximate its said fitting; wherein said piping connects said fittings in a regular pattern to permit vapors to travel through said piping and said fittings and to accumulate within said bags, under pressurized conditions.

2. The vapor trapping container of claim 1 wherein said safety means is selected from the group flame arrestor, flow restrictor, or both.

3. A vapor trapping container comprises:

one or more bags, flexible and having a generally round cross section, said bags being impervious to hydrocarbon vapors;

one or more stems, being hollow, generally round in cross section, and perforated in a regular pattern, said stems extend the length of said bags and are generally centered within said bags, said bags rest upon the upper terminus of its stem and attach snugly to said stem opposite the terminus;

one or more fittings, being hollow and of round cross section to accept said stems; piping, hollow and generally round in cross section, said piping connects said fittings and attaches to an external vapor source;

a flamer arrestor connected serially with said piping and away from the first of said fittings;

a housing, having a rectangular shape in plan and in section and sufficient volume to accommodate said bags when inflated; and, a base, upon which said housing rests and said piping extends, said piping being generally centered upon said base, wherein vapors exit the vapor source, enter said piping, inflate said bags under ambient air pressure and deflate said bags when the vapor source pressure declines.

4. The vapor trapping container for use in conjunction with a fuel storage tank, said vapor trapping container including at least one flexible bag, said bag being approximately vertically oriented, a stem operatively associated with each bag, said stem providing for delivery of vapors into the bag, and evacuation of injected vapors therefrom, piping connecting with the stem and communicating within the fuel storage tank, for transferring said vapors therefrom or thereto, whereby excess vapors within the fuel storage tank may be delivered to the vapor trapping container, or removed therefrom.

5. The vapor trapping container of claim 4 wherein said stem includes a length of pipe, said pipe being approximately vertically disposed, and said pipe having a series of perforations provided therethrough for delivery or evacuation of vapors from the bag.

6. The vapor trapping container of claim 5 wherein said pipe extends upwardly within the bag.

7. The vapor trapping container of claim 6 wherein there are at least two stems each having a pipe extending within respective bags, provided within the vapor trapping container.

* * * * *